US008100046B2

(12) United States Patent
Tünkers

(10) Patent No.: US 8,100,046 B2
(45) Date of Patent: Jan. 24, 2012

(54) PROCEDURE FOR THE LOADING OF A WORKING CYLINDER, CONTROL MODULE FOR IT, WORKING CYLINDER AND UTILIZATION OF THE SAME

(75) Inventor: Josef-Gerhard Tünkers, Ratingen (DE)

(73) Assignee: Tunkers Maschinenbau GmbH, Ratingen (DE)

( * ) Notice: Subject to any disclaimer, the term of this patent is extended or adjusted under 35 U.S.C. 154(b) by 670 days.

(21) Appl. No.: 12/278,999

(22) PCT Filed: Apr. 27, 2007

(86) PCT No.: PCT/EP2007/003745

§ 371 (c)(1),
(2), (4) Date: Aug. 11, 2008

(87) PCT Pub. No.: WO2007/128437

PCT Pub. Date: Nov. 15, 2007

(65) Prior Publication Data

US 2009/0000468 A1 Jan. 1, 2009

(30) Foreign Application Priority Data

May 10, 2006 (DE) ..... 10 2006 022 030
Sep. 6, 2006 (DE) ..... 10 2006 041 707

(51) Int. Cl.
*F15B 11/028* (2006.01)
*F15B 15/20* (2006.01)

(52) U.S. Cl. ..... 91/395; 91/392; 269/32

(58) Field of Classification Search ..... 91/392, 91/394, 395, 399; 92/163, 403; 269/32
See application file for complete search history.

(56) References Cited

U.S. PATENT DOCUMENTS 6,435,494 B2 * 8/2002 Takahashi et al. ..... 269/32

FOREIGN PATENT DOCUMENTS

| | | | |
|---|---|---|---|
| DE | 333903 | | 3/1921 |
| DE | 1941785 | | 3/1971 |
| DE | 19512429 | | 10/1996 |
| DE | 29700887 | U1 | 4/1997 |
| DE | 19616441 | | 6/1997 |
| DE | 19824579 | C1 | 6/1999 |
| DE | 19930990 | C1 | 12/2000 |
| DE | 10260138 | A1 | 7/2004 |
| DE | 102004027849 | A1 | 1/2006 |
| DE | 102004034280 | A1 * | 2/2006 |
| DE | 102004063463 | | 3/2006 |

* cited by examiner

*Primary Examiner* — Thomas E Lazo
(74) *Attorney, Agent, or Firm* — Antonelli, Terry, Stout & Kraus, LLP.

(57) ABSTRACT

The invention demonstrates how energy saving working cylinders are loaded with fluid under pressure in order, for example, to power devices for tensioning (toggle joint tensioning apparatus), and/or compressing and/or jointing and/or stamping and/or embossing and/or punching and/or welding, if necessary, under the interposition of gearing parts such as guides, parallelogram gears, toggle joint articulations or the like, with the fluid supply being controlled in such a way during the no-load stroke (idle stroke) of the piston (4) that only the forces of inertia and/or weight and/or the forces of friction of moveable parts are overcome and pressure is not applied from the fluid until the power stroke of the piston (4).

14 Claims, 10 Drawing Sheets

PROCEDURE FOR THE LOADING OF A WORKING CYLINDER, CONTROL MODULE FOR IT, WORKING CYLINDER AND UTILIZATION OF THE SAME

BACKGROUND OF THE INVENTION

The invention concerns a procedure for loading a piston-cylinder unit with fluid under pressure, primarily for use in the manufacture of motor vehicle bodywork.

The invention also concerns a control module for loading a piston-cylinder unit with fluid under pressure, primarily for use in the manufacture of motor vehicle bodywork.

The invention also concerns a piston-cylinder unit as a working cylinder to be loaded with fluid under pressure, primarily for use in the manufacture of motor vehicle bodywork.

Finally, the invention concerns the use of a working cylinder of this kind to power devices for tensioning and/or compressing and/or joining and/or stamping and/or embossing and/or punching and/or welding, if necessary, under the interposition of a toggle joint or other gearing parts, e.g. for use in the manufacture of motor vehicle bodywork.

Piston-cylinder units are referred to in the industry for short as "working cylinders". Where the term "working cylinder" is used in the following, it is understood to mean not only a cylinder but also an operable drive unit comprising at least one cylinder and at least one piston guided in this cylinder so as to be longitudinally displaceable and to seal it and having a piston rod disposed on one side of the said piston, which piston rod is preferably sealed and made to project from the said cylinder chamber and which powers devices primarily for tensioning and/or compressing and/or joining and/or stamping and/or embossing and/or punching and/or welding. In the case of such devices e.g. the piston rod often drives under interposition of at least one toggle joint other device parts such as a tensioning arm which cooperates with an opposing member or an expanding mandrel or a centring mandrel or a jointing device or a stamp, a device part for punching or also device parts, for example, under interposition of a toggle joint, actuatable welding electrodes.

Devices for tensioning, compressing, joining, stamping, embossing, punching and welding are used in many forms in, for example, the manufacture of motor vehicle bodywork. Tensioning devices are often constructed as "toggle tensioning devices" and hold body sheets in position until they are permanently fastened on by means of spot-welding, adhesion, clinching, etc., while other devices, for example, function as under-floor clamps and power a centring mandrel under interposition of a link mechanism, e.g. a parallelogram gear, to align one with the other and centre a number of sheets. Examples of these are to be found in, amongst others, catalogs of Tünkers Maschinenbau GmbH "Product Range", "Tensioning Technology for Professional Series Manufacture", "Tensioning Systems, Handling, Forming Technology, Stamping, Edging, Pressure Joining, Embossing" and in patent specifications DE 196 16 441 C1, DE 198 24 579 C1 and DE 199 30 990 C1.

In all these procedures, control systems, working cylinders and devices full pressure is need only for the last part of the working stroke. This means that for 90 percent and more of the setting stroke of the piston concerned and its piston rod—idle stroke—only a weak force is necessary, for example, to overcome friction and certain mass inertia and gravitational forces. Supply with fluid under pressure, for example, hydraulic fluid or compressed air and so the pump output and its driving power, however, is in the present state of the art needed for the entire stroke of the assigned piston with piston rod, for example, toggle joint and the like, which means that the greater part of the driving power is lost.

SUMMARY OF THE INVENTION

The invention is based on the problem of doing away with the disadvantages of the state of the art and helping to considerably improve the energy balance and save costs in all areas, that means, both in the case of the procedures known so far for the loading of working cylinders, primarily for use in the manufacture of motor vehicle bodywork and in the case of the control module for fluid under pressure for loading working cylinders of this kind and in the case of the use of working cylinders for devices for tensioning, compressing, joining, stamping, embossing, punching and welding.

This problem is solved by a procedure for loading a piston-cylinder unit (working cylinder), primarily for use in the manufacture of motor vehicle bodywork, with at least one piston which is longitudinally and sealingly displaceable in a cylinder by fluid pressure and which is on one side assigned a piston rod which is made to project from the cylinder and which powers device parts for tensioning and/or joining and/or stamping and/or embossing and/or punching and/or welding, if necessary, under interposition of gear parts such as guide rods, parallelogram gears, toggle lever arrangements or the like, where during the idle stroke (setting stroke) of the piston the fluid feed is controlled in such a way that only the inertia and/or gravitational forces and/or frictional forces of moveable parts are overcome and the piston is not loaded with pressure from the fluid until the power stroke.

In order to adjust the different pressures during the idle stroke and power stroke in keeping with the output, particularly the air flow or hydraulic fluid flow rate, in the case of the procedure according to the invention one working cylinder is filled with pressure medium on both sides of the piston during the idle stroke so that during the idle stroke (setting stroke) only the differential pressure, which is the difference between the piston surface loaded by the fluid pressure and the opposite side of the piston-ring surface, acts in the direction of the working stroke. The fluid and in particular energy consumption for the pump and its drive motor, particularly compressed air and hydraulic fluid consumption, are considerably reduced, for example, by 50%, by it.

To initiate the actual pressure stroke (working stroke), the piston-ring side is relieved of pressure, while the piston surface remains loaded with pressure from the medium. The fluid pressure can develop thereby and, for example, load the tensioning arm of a toggle joint device or pressing device, a joining device, a stamped part, part of a device for embossing or punching, or welding dies and crimpers, for example, under interposition of a toggle joint.

Control of pressure medium loading in the case of the invention is either pressure-dependent or path-dependent. For example, to initiate the power stroke through the piston a valve, for example, a piston valve is actuated, relieving the pressure on the piston-ring side and maintaining the load acting on the piston surface from the full fluid pressure. The full pressure can thereby develop in the working direction in order to be able to act, for example, on a toggle tensioning device or a device for compressing, joining, stamping, embossing, punching or welding, primarily under interposition of a toggle joint. The retraction of the piston rod and thus the return movement of the piston are achieved by loading the piston-ring side with pressure from the already previously reversed valve.

In a further preferred embodiment, the control of the fluid during the power stroke, that is, on completion of the setting stroke (idle stroke) is derived from the movement of the piston.

In a very advantageous embodiment, the control of the fluid during the power stroke, that is, on completion of the setting stroke (idle stroke), is derived from the movement of the piston.

According to the invention control parts of the control system, for example, the piston valve and ducts, can be wholly or partly integrated in the cylinder cover and/or in the cylinder base, and, if required, also in the side walls of the cylinder, as a result of which the overall dimensions of the hitherto usual devices of the kind needed in the manufacture of motor vehicle bodywork for tensioning, compressing, joining, stamping, embossing, punching or welding, primarily using toggle levers, are not increased, so that the standards hitherto used in, for example, the automotive industry, with regard to outside dimensions are retained. The arrangement can be applied both with round and flat (rectangular) and oval or flattened-oval cylinders.

Working cylinders designed in accordance with the invention can be used to great advantage in many forms, particularly in the automotive industry, for example, in devices for tensioning, compressing, jointing, stamping, embossing, punching and welding in the manufacture of motor vehicle bodywork. Existing production lines can be fitted with working cylinders of the kind forming the object of the invention without structural changes, thus enabling the cost of energy for operating production lines of this kind to be considerably reduced.

It is particularly advantageous if in a working cylinder in accordance with the invention is used so that the piston rod controls a valve, for example, a piston valve at the end of the idle stroke (setting stroke) in such a way that the full pressure from the pressure medium acts on the active side of the piston. Working cylinders which are constructed in this way can be used to special advantage in toggle joint tensioning devices in the manufacture of motor vehicle bodywork.

In a particularly advantageous embodiment, a detachable coupling is provided for which does not make a connection between the piston rod and the valve but at the end of the idle stroke (setting stroke) acts automatically and controls the valve in such a way that the pressure from the pressure medium acts fully on the side of the effective piston.

Some embodiments are especially advantageously suitable in devices in which toggle joint arrangements are provided for, for example, for toggle lever tensioning devices, and with spot-welding devices and stamping, joining and embossing devices powered via toggle levers.

BRIEF DESCRIPTION OF THE DRAWINGS

Further features and advantages result from the following descriptions of drawings in which the invention is—partly schematically—illustrated by a number of embodiments.

DETAILED DESCRIPTION OF THE INVENTION

Figure 1:
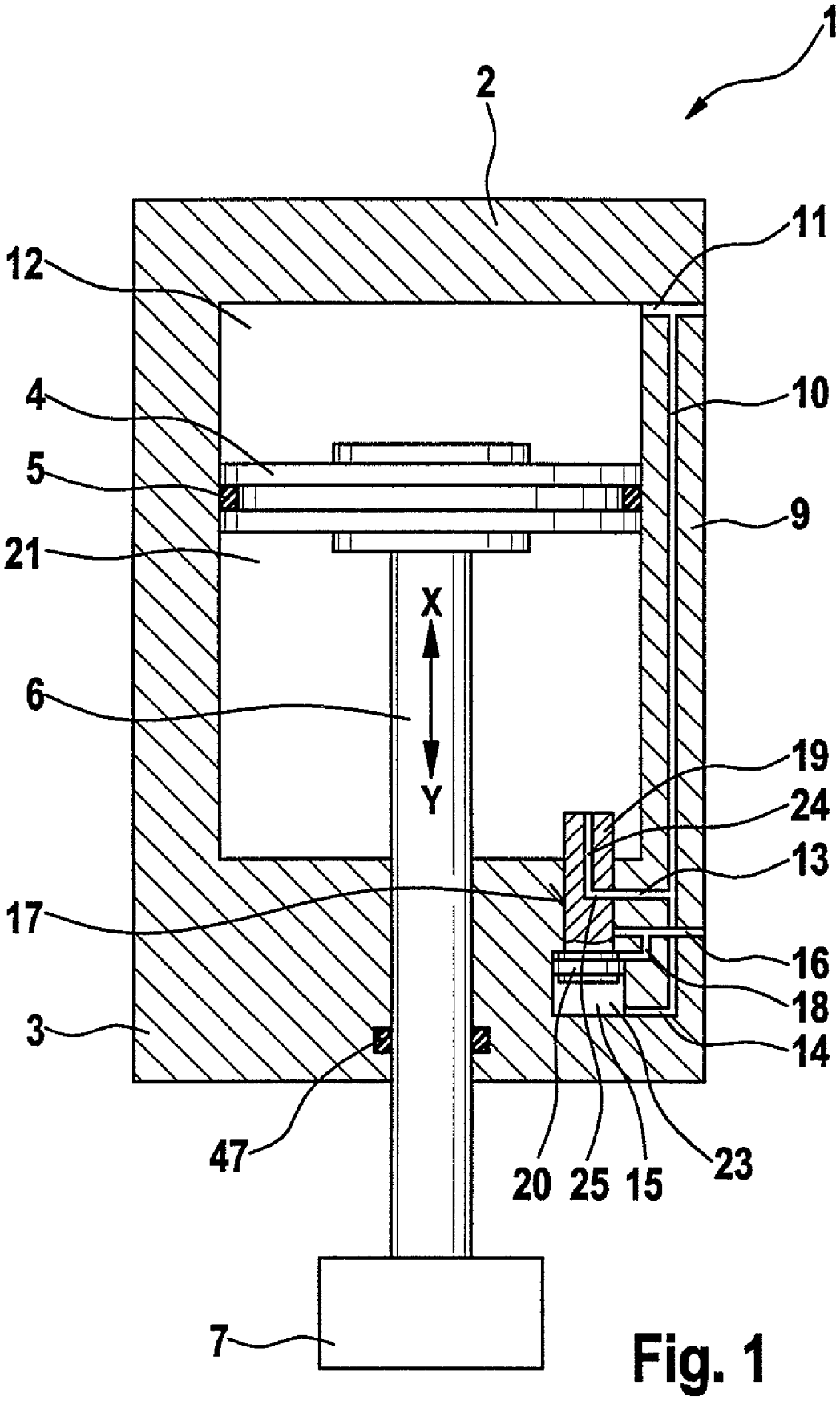
FIG. 1 shows an axial longitudinal section of a working cylinder where the piston with the piston rod is in an intermediate position of the idle stroke in the direction Y.

Shown on the drawing with reference number 1 is a cylinder incorporating a cylinder base 2 and a cylinder cover 3. Cylinder base and/or cylinder cover can be detachably and replaceably connected to the actual cylinder with bolts (not shown).

Figure 2:
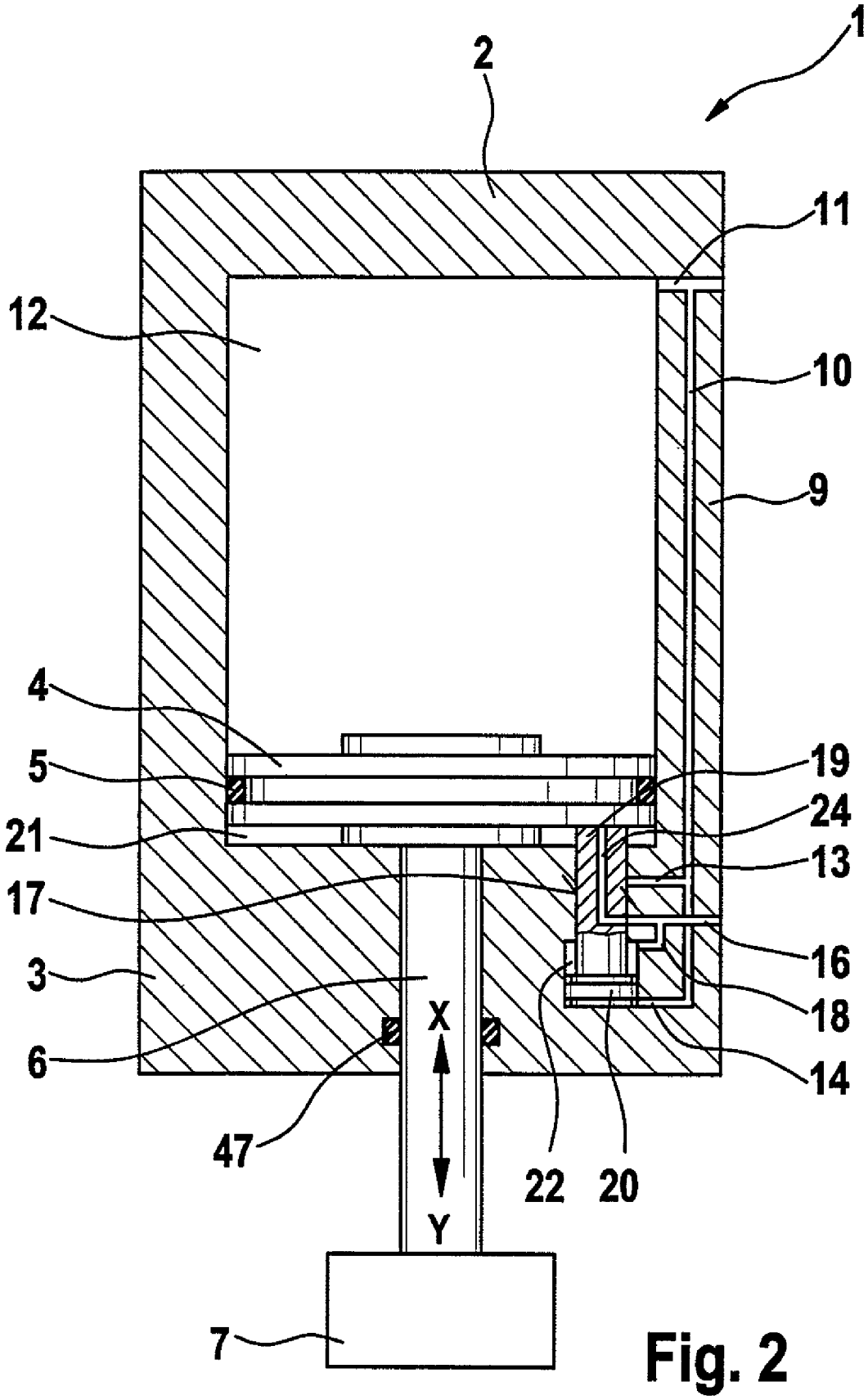
FIG. 2 shows a longitudinal section of the working cylinder shown in FIG. 1 in the end position of the working stroke (power stroke)
Figure 5:
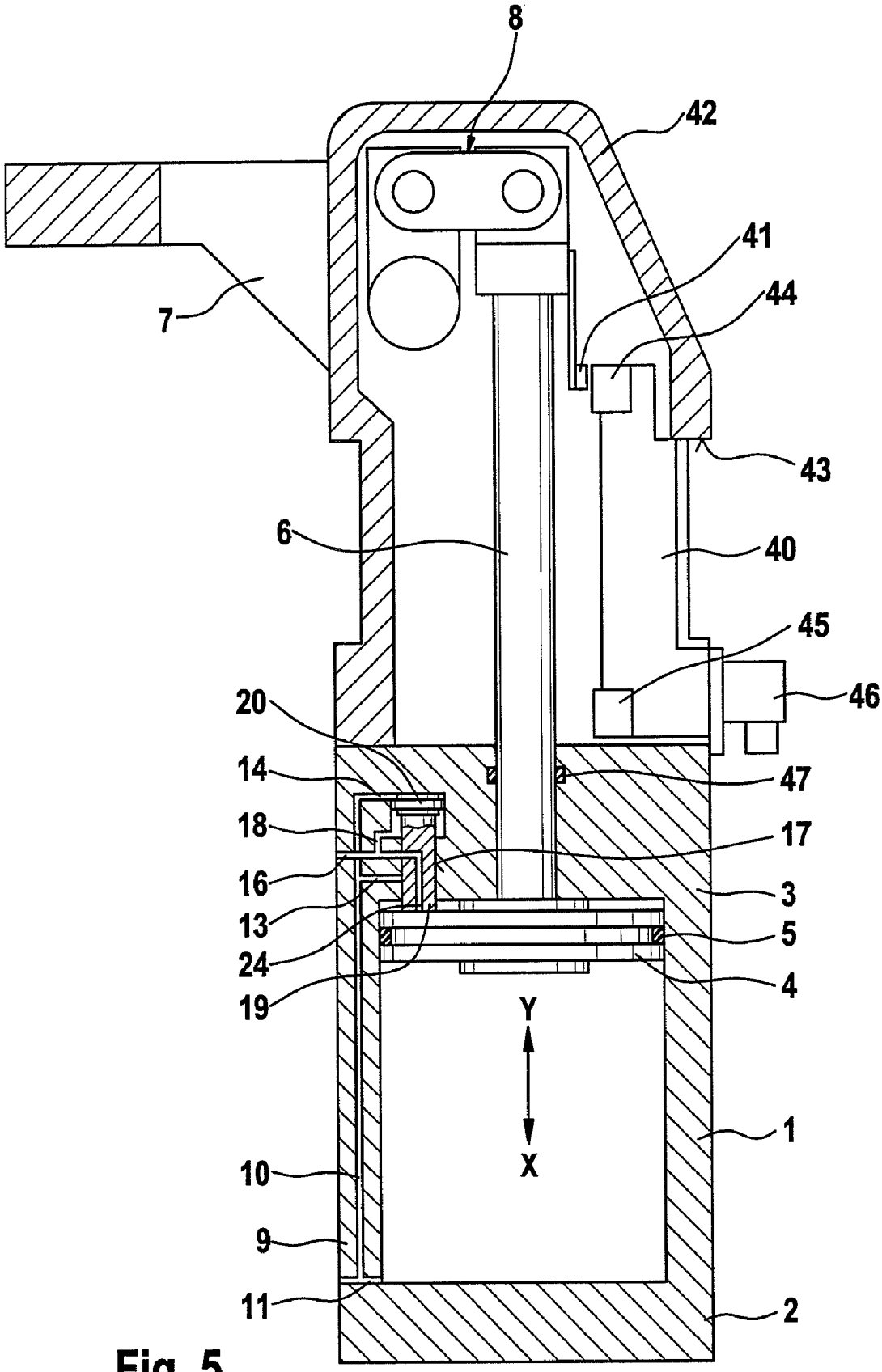
FIG. 5 shows a toggle lever tensioning device in longitudinal section with a working cylinder in accordance with the invention.

Disposed in the cylinder 1 and able to move in a longitudinal direction in opposite directions, that is, in direction X or Y, and sealed with a sealing element 5, is a piston 4. Assigned to the piston 4 on one side is a piston rod 6 via which suitable device parts for tensioning 7, compressing, joining, stamping, embossing, punching and welding are powered. These device parts 7 or the like are indicated in FIGS. 1 and 2 only schematically. Between these device parts 7 a toggle lever arrangement can also be disposed as shown in FIG. 5 and which is marked with the reference number 8. The device part 7 is shown in FIG. 5 by a tensioning arm, which cooperates with other device parts, for example, with an opposing member, also known as a jaw. The fundamental construction of such devices for tensioning, for example, toggle lever tensioning devices, for compressing, joining, stamping, embossing, punching and welding is state of the art and for simplicity's sake need not be described here. Devices of this kind can be found in the specifications shown in the enclosed bibliography and are also described in the preamble to the description of this patent application.

In all the embodiments as shown on the drawing the cylinder 1 can in a cross-section at right angles to its longitudinal axis be designed round, oval, rectangular, flattened-oval or otherwise.

In one side 9 of the cylinder in the embodiment according to FIGS. 1 and 2 is a longitudinal duct 10 which is connected fluid-conductingly at the end portion facing the cylinder cover 3 to a transverse duct 11, which leads at one end into the working cylinder chamber 12 and at the other end leads out of the working cylinder chamber and is connected here to a control system (not shown here) for a suitable fluid inlet and outlet. This fluid may be hydraulic fluid, compressed air or a quasi-fluid of the kind used to power working cylinders. In the manufacture of motor vehicle bodywork mainly compressed air will be used, as this is available everywhere in workshops and particularly on assembly lines, although it is not absolutely necessary for realization of the invention.

At a distance from its other end the longitudinal duct 10 is fluid-conductingly connected to a branch duct 13 disposed in the cylinder base, while the longitudinal duct 10 is at its other end also fluid-conductingly connected to a portion 14 of the duct which leads fluid-conductingly into a chamber 15.

Disposed in the cylinder base is a further duct 16 which leads into a cylindrical hole 17. Connected to this duct 16 is a chamber duct 18 which leads at one end fluid-conductingly to the duct 16 and at the other end into the chamber 15.

Longitudinally-displaceably and sealingly guided in the hole 17 is a piston valve 19 a certain longitudinal portion of which projects into the cylinder return chamber 21 and is longitudinally-displaceably and sealingly guided in the chamber 15 by a piston 20. The chamber 15 is divided by this into two cylinder chambers, into one 22 of which the chamber duct 18 leads fluid-conductingly, while duct portion 14 leads fluid-conductingly into cylinder chamber 23.

The piston valve 19 incorporates a longitudinal duct 24 which in the embodiment shown extends coaxially to the longitudinal axis of the piston valve 19 over part of its length and incorporates a fluid-conducting branch duct 25 running at right angles to the longitudinal axis and connected to the longitudinal duct 24.

The working cylinder shown in FIGS. 1 and 2 is built into the toggle lever tensioning device shown in FIG. 5. The working cylinder shown in FIGS. 1, 2 and 5 operates as follows:

In the position shown in FIG. 1 the transverse duct 11 is connected to a fluid source (not shown), which supplies a fluid under pressure, for example, compressed air. This causes the working cylinder chamber 12 to be loaded with pressure by the compressed medium via the longitudinal duct 10, the branch duct 13, the branch duct 13 and the branch duct 25 and the longitudinal duct 24 in the piston valve 19 also to the cylinder return chamber 21 with the same pressure from the compressed medium. This means that both the working cylinder chamber 12 and the cylinder return chamber 21 are loaded simultaneously by the fluid under pressure. This causes the fluid pressure to act on the piston 4 from both sides. Since, however, the fluid pressure on the side on which the piston rod 6 is located loads a smaller surface, that is, the annular surface, a stroke displacement force results in the direction Y, that is, the working direction, and this is determined by the difference between the fluid-effective piston surfaces. As a result, the piston 4 and the piston rod 6 and any connected device parts, for example, the toggle lever arrangement 8 and the device parts 7, e.g. as tensioning arm or other device parts such as are necessary for compressing, joining, stamping, embossing, punching and welding, move with only relatively low driving force during the idle stroke. As a result, the driving energy needed during the idle stroke (setting stroke) reduces in proportion to the compressed medium-effective surfaces in the working cylinder. For example, by 50 percent. This can also be determined by the choice of fluid-effective piston surfaces, for example, by varying the cross-section of the piston rod 6 correspondingly. For example, in the case of toggle lever tensioning devices or other devices the piston rod may be enlarged in diameter in order to still further reduce the energy to be used during the idle stroke (setting stroke). If the piston 4 comes up against the end face of the piston valve 19, the piston valve is displaced accordingly in a longitudinal direction, until it has reached the position shown in FIG. 2. In this position the branch duct 13 is blocked off from the cylinder return chamber 21 and fluid-conductingly connected to the duct 16 via the longitudinal duct 24 in the piston valve 19 and its branch duct 25, causing the cylinder return chamber 21 to be evacuated of air. This evacuation can be carried out by means of a suitable control system (not shown).

The inward movement of the piston rod 6, that is, a movement in direction X (opening stroke), is carried out by corresponding control of the control device not shown, causing the piston-ring side, that is, the cylinder return chamber 21, to be loaded with pressure from the compressed medium through the valve previously already reversed and shown in the present as piston valve 19. In this case the duct 16 is connected to the pressure from the compressed medium via the control system. The fluid is thereby conducted in to the cylinder return chamber 21 via the duct 16 and the longitudinal duct 24 in the piston valve 19. The pressure from the compressed medium is also transmitted to the chamber portion 22 via the chamber duct 18 and loads the piston 20 and thereby holds the piston valve 19 in the position shown in FIG. 2.

When the idle stroke (setting stroke) is initiated in direction Y, the fluid pressure is again transmitted via transverse duct 11 and the duct 10 to the branch duct 13 and also via the duct portion 14 in the chamber 15 and loads the piston 20, causing this to be displaced into its position shown in FIG. 1, whereupon the working cycle previously described can be repeated.

Figure 3:
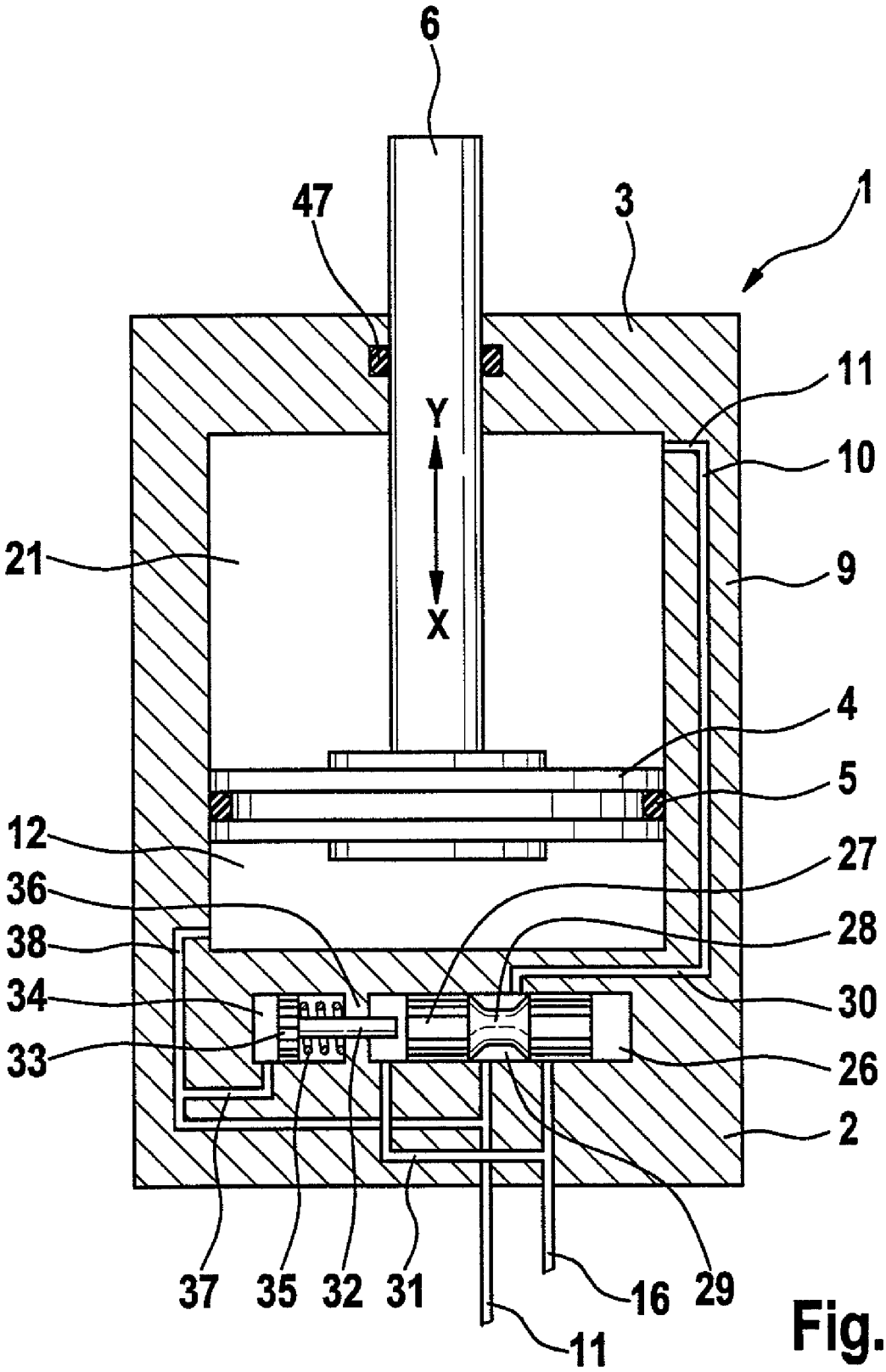
FIG. 3 shows a longitudinal section of a further embodiment of a working cylinder in an intermediate position of the idle stroke in the direction Y.
Figure 4:
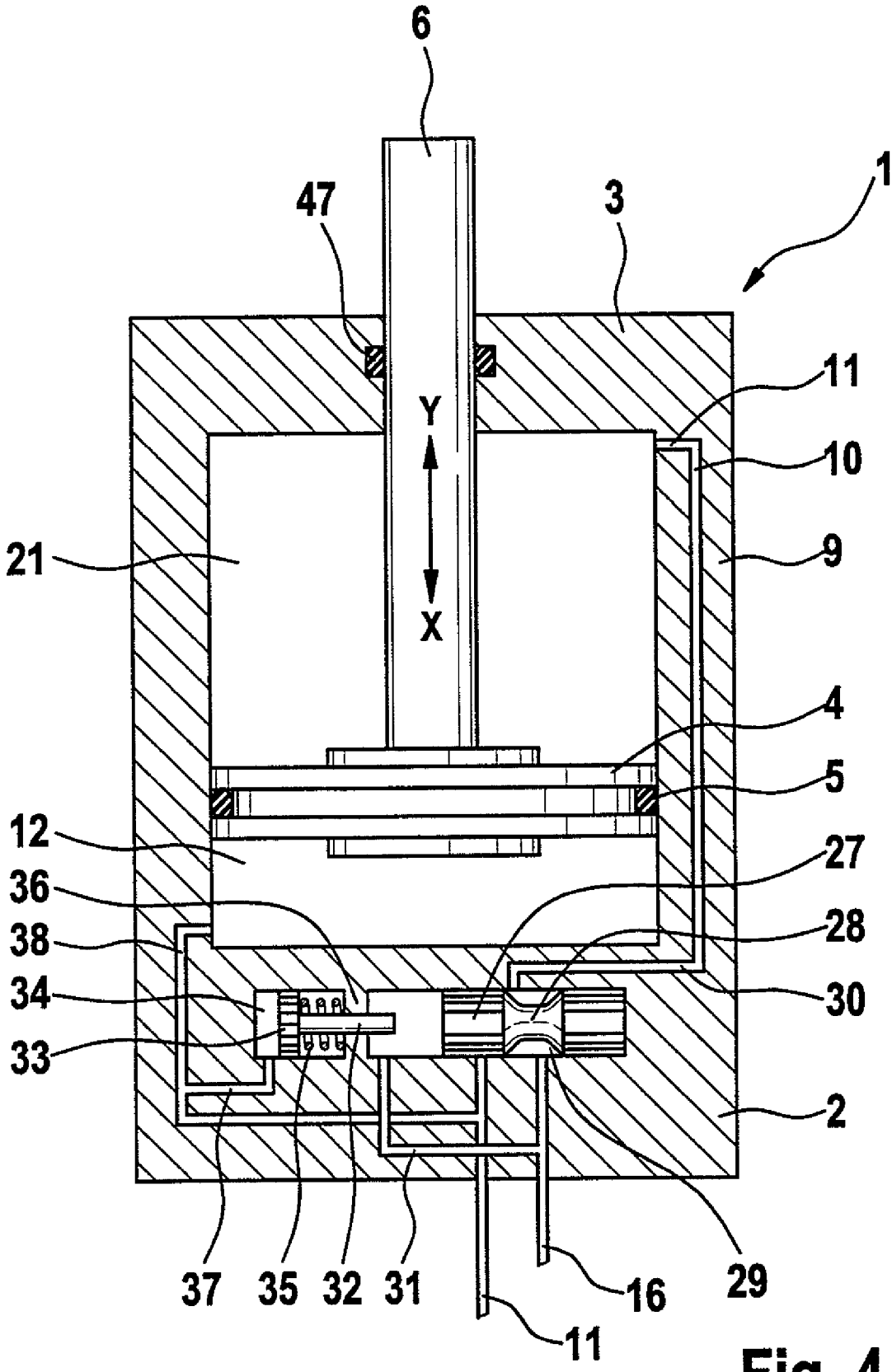
FIG. 4 likewise shows an axially longitudinal section of the working cylinder shown in FIG. 3 in an intermediate position during the return movement of the piston in direction X (opening stroke)

In the embodiment in accordance with FIGS. 3 and 4 the same reference numbers are used for parts having the same function.

Disposed in the cylinder base 2 at right angles to the stroke of piston 4 is a valve chamber 26 in which a piston valve 27 is longitudinally-displaceably in both directions and sealingly disposed in its longitudinal direction.

The piston valve 27 has at its ends piston-shaped thickened portions and approximately in its middle longitudinal portion 28 a diameter reduction, thus producing an annular chamber 29 around its circumference.

Connected to the valve chamber 26 and spaced apart in turn are a transverse duct 11 and a duct 16 which can be alternately connected to the pressure from the compressed medium via a suitable fluid control system (not shown) or also evacuated of air.

The longitudinal duct 10 disposed in the cylinder wall 9 is in turn connected via a transverse duct 11 to the working cylinder chamber 12 and also leads fluid-conductingly into a duct 30 which leads fluid-conductingly into the valve chamber 26 in the area of the annular chamber 29.

The duct 16 is likewise connected via a duct portion 31 to a part of the valve chamber 26 into which a push rod 32 projects longitudinally displaceably and sealingly, which push rod is integrally connected to a piston 33 disposed longitudinally displaceably and sealingly in a chamber 34 and constantly loaded in a direction away from the piston valve 27 by a pretensioned compression spring element 35. The compression spring element 35 is braced at one end against a partition wall 36 and at the other end against the piston 33.

On the side of the piston facing away from the compression spring element emerges a branch duct 37, which is connected fluid-conductingly to a duct portion 38, which can be fluid-conductingly connected to the transverse duct (FIG. 3). The duct portion 38 leads fluid-conductingly into the cylinder return chamber 21.

The embodiment shown in FIGS. 3 and 4 operates as follows:

In the representation according to FIG. 3 the piston 4 performs an idle stroke in direction Y. The transverse duct 11 is connected to a suitable fluid source, for example, compressed air, by means of a control system (not shown), causing the duct portion 38 to be loaded with fluid pressure, thereby causing the cylinder return chamber 21 and also the working cylinder chamber 12 to be loaded with pressure from the compressed medium via the annular chamber 29 and the duct 30 and the transverse duct 11. As a result, the piston 4 and the piston rod 6 and any connected device parts not shown in FIGS. 3 and 4, for example, a toggle lever arrangement 8 with a device part 7, for example, a tensioning arm (FIG. 5) are moved by the differential force resulting from the pressure-effective piston surfaces. If the piston 4 reaches the position in which the full power stroke is performed, the pressure from the compressed medium is transmitted into the chamber 34 via the duct portion 38 and the branch duct 37 and loads the piston 33 which then, overcoming the restorative force of the compression spring element 35, presses the push rod 32 against the piston valve 37, thereby blocking off the transverse duct 11 from the annular chamber 29, so that the cylinder return chamber 21 is no longer loaded by the pressure from the compressed medium. As a result, in this position the full pressure from the compressed medium acts on the pressure-effective surface of the side of the piston 4 not provided with the piston rod 6, whereupon the device concerned, for example, a toggle lever tensioning device, or a device for compressing, joining, stamping, embossing, punching or welding can perform its full working stroke. The cylinder return chamber 21 is then relieved of pressure.

Figure 6:
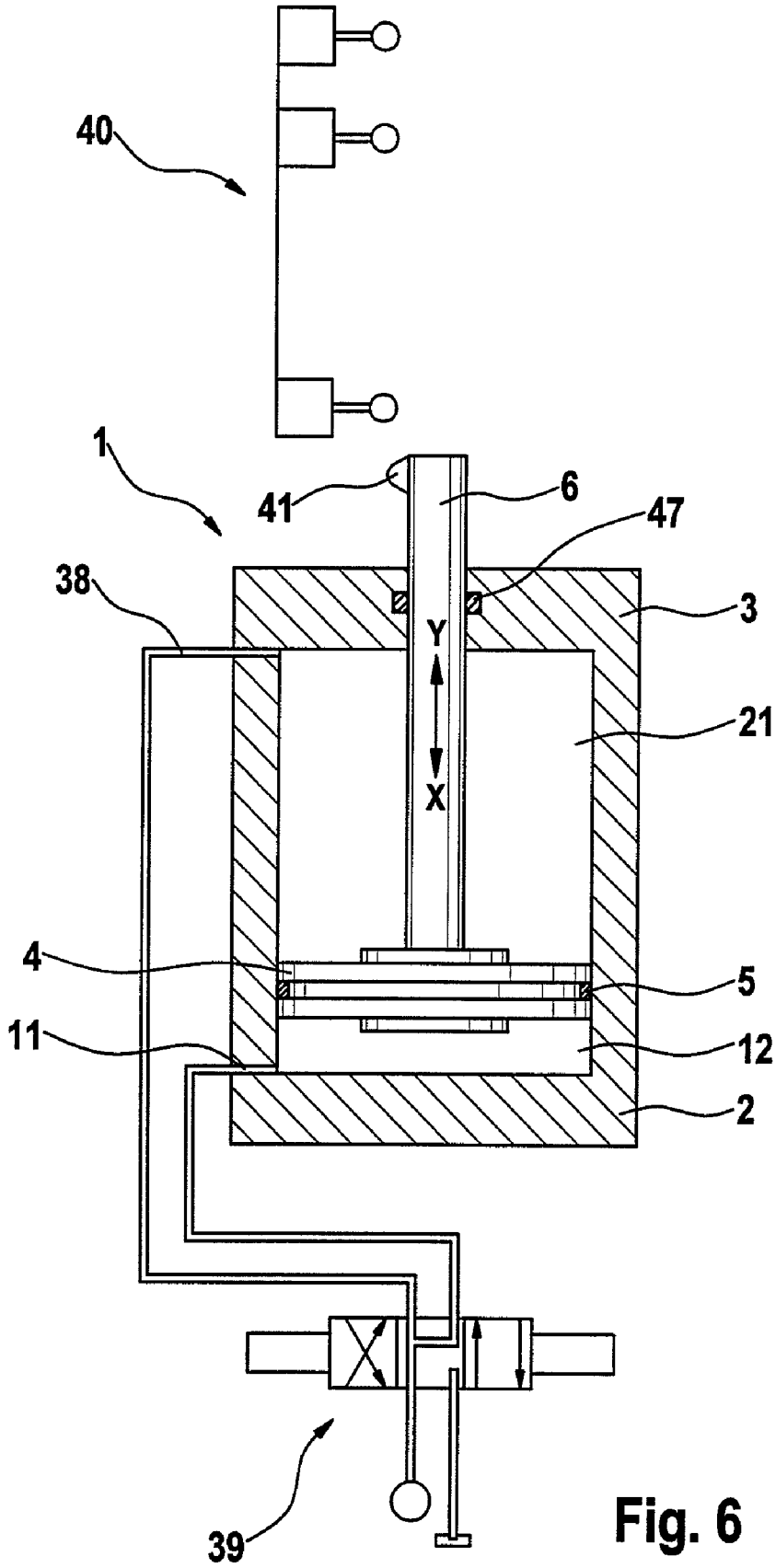
FIG. 6 shows a further embodiment, partly in longitudinal section, of a working cylinder with an external control device, with an interrogation device.

In the embodiment according to FIG. 6 a multi-port valve 39 is incorporated in a system control system (not shown) outside the actual working cylinder and cooperates with a fluid source (likewise not shown), for example, a compressed air source or a hydraulic fluid source, to which a compressed medium is fed under pressure in a suitable manner, for example, via at least one motor-powered pump.

Again, the same reference numbers were used for parts having the same function.

The duct portion 38 can be connected to the cylinder return chamber 21 and the transverse duct 11 to the working cylinder chamber 12 via the multi-port valve 39. During the idle stroke in turn only the differential pressure acts on the piston 4 and displaces the piston during the working stroke in direction Y.

To initiate the power stroke, the control is reversed so that the cylinder return chamber 21 is not longer loaded with pressure from the fluid but only the working cylinder chamber 12, as a result of which the full pressure from the compressed medium is available when initiating the power stroke, for example, in a toggle lever tensioning device or a device for compressing, joining, stamping, embossing, punching or welding. The reference number 40 refers to an only schematically indicated device for detecting the position of the piston rod 6. This device may be a cassette known from toggle lever tensioning devices, where the respective position of the piston rod 6 can be detected by means of pneumatic switches, microswitches, inductive switches or the like, for example, via a switching flag 41. The device 40 may also be assigned direct to cylinder 1 in the form of a cassette, for example, be disposed in a recess in the cylinder, as shown, for example, in FIG. 5, where the device for detecting the various positions of the piston rod 6 and thus indirectly also the angular position of the tensioning arm is disposed in a slot 43 located on the rear of the tensioning head 42. This slot 43 may preferably extend in a longitudinal direction of the tensioning head 42 and so parallel to the direction of stroke of the piston rod 6 or also at right angles to this. The device 40 preferably extensively seals the slot fluid-tight and dust-tight against ingress from outside. The device can also be constructed as an adaptive cassette, where by selecting certain positions one or more times these positions can be stored and reversed electronically in a memory in order to assign various angular positions to, for example, a tensioning arm. The device parts 44, 45 can be displaced relative to each other in order to allow for various working positions, for example, tensioning positions. The device parts 44, 45 may be switches, e.g. electrical switches or inductive switches which are energized through the switching flag 41. The data are interrogated via a suitable electrical or electronic plug 46 and transmitted by wire to, for example, a remote control station, data processing system or the like. These data can be incorporated into a production control system or automatic control system and be located in, for example, a production line employed in the manufacture of motor vehicle bodywork. In the same way, however, these different means can also be used in devices for compressing, joining, stamping, embossing, punching and welding.

In all the embodiments there is a seal, indicated by the reference number 47, through which the piston rod 6 can be fluid-tightly made to project from the working cylinder.

Figure 7:
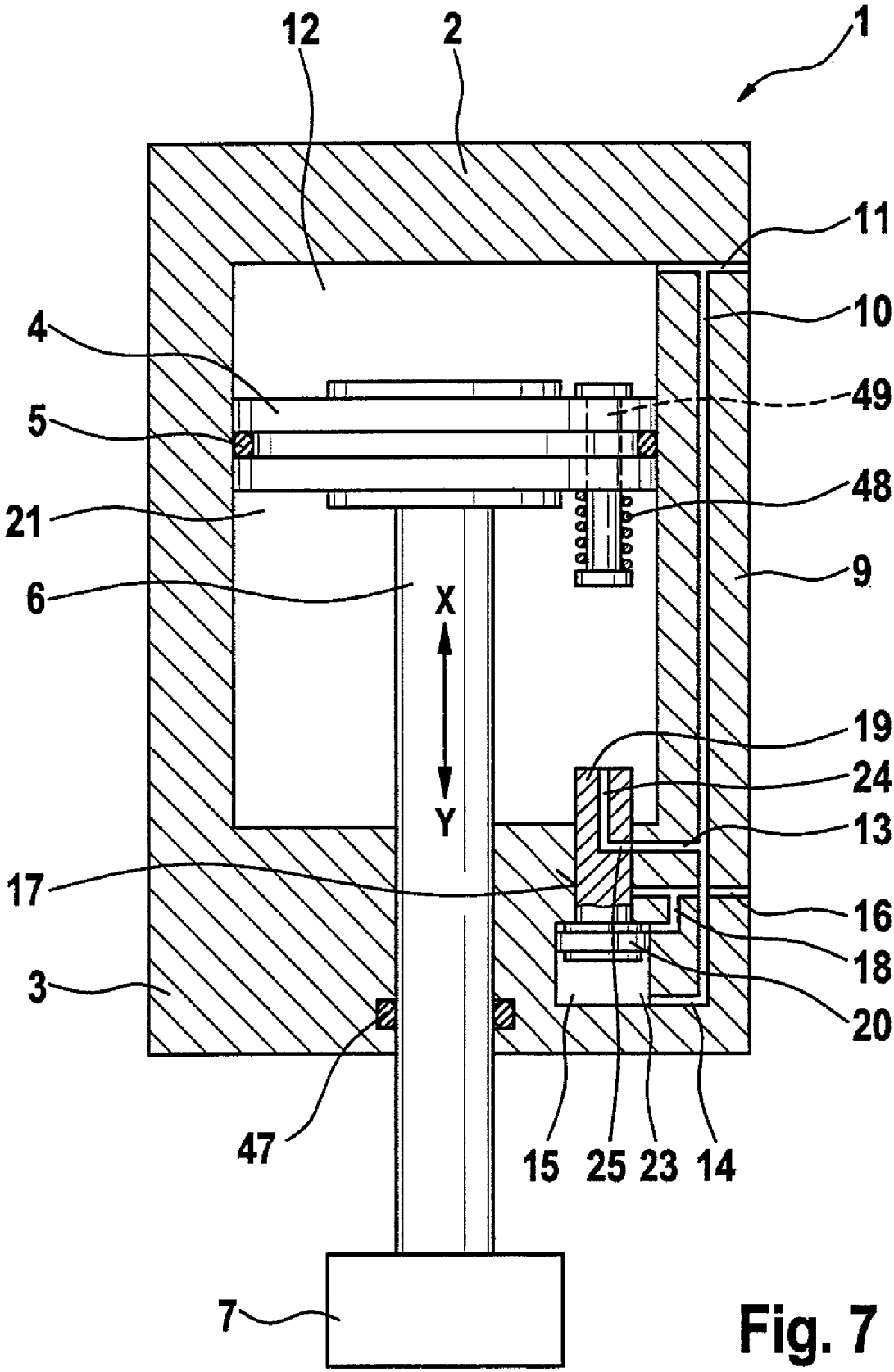
FIG. 7 shows a further embodiment, partly in longitudinal section.

In the embodiment according to FIG. 7 the piston 4 is assigned a control pin 49 which can be moved against the restorative force of a compression spring element 48 and which is displaceably and sealingly disposed longitudinally in a hole in the piston 4 and which cooperates at its front end with the piston valve 19 in such a way that, when the idle stroke is completed, the control pin 49 comes up against the front end of the piston valve 19 and pushes this in direction Y, that is, into the cylinder cover 3. This can begin shortly beforehand, preferably at the beginning of the power stroke, whereupon the feed of compression medium to the piston-ring side 21 is interrupted and the cylinder return chamber 21 evacuated of air so that the pressure from the fluid loads only the piston side and, for example, loads a toggle lever tensioning device, crimpers, a combined tensioning and welding device provided with toggle lever joints, a stamping or embossing device or the like. In the embodiment shown the pressure spring element is braced under pretension at one end against the piston 4 and at the other against a piston-shaped thickened portion.

Figure 8:
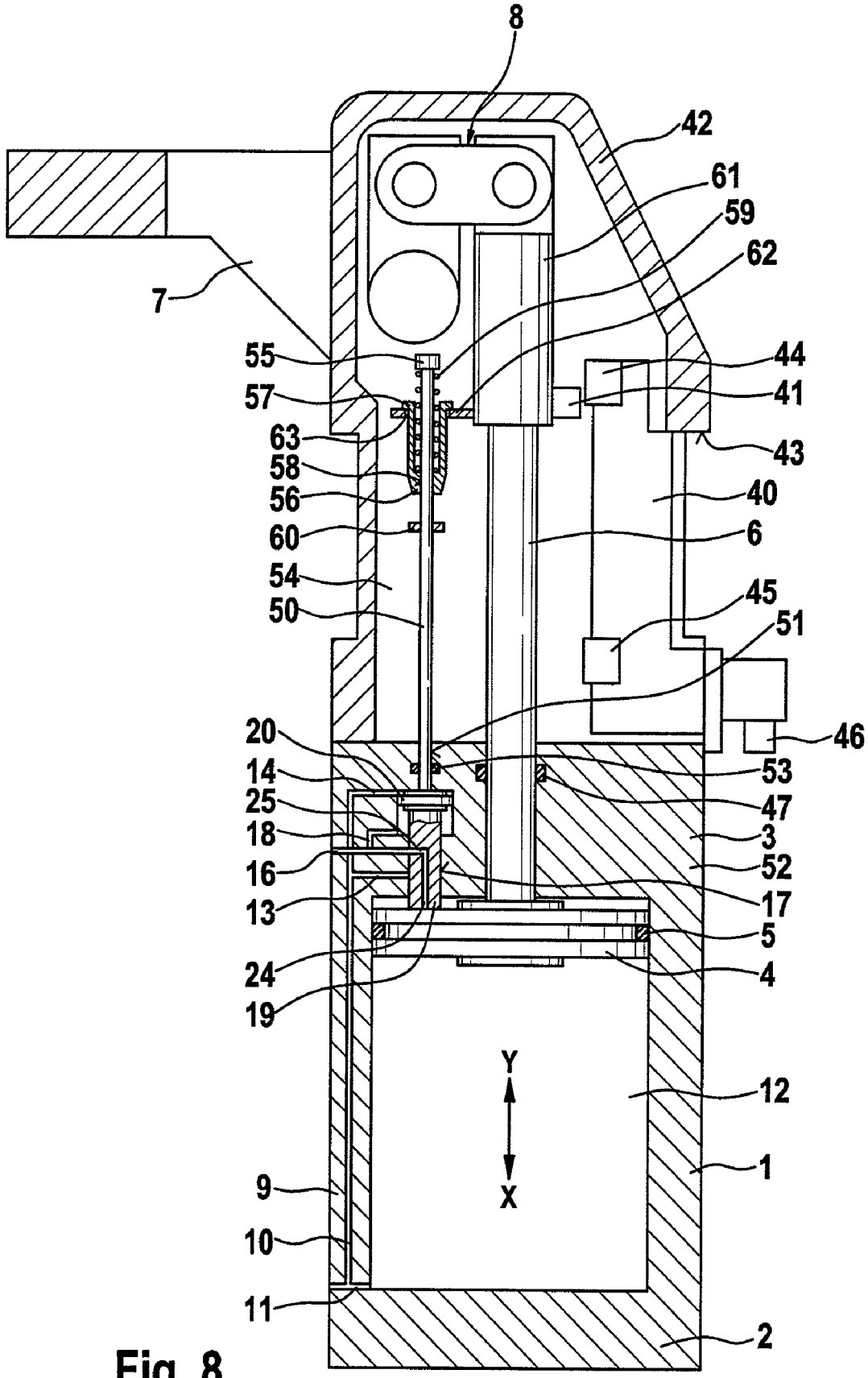
FIG. 8 shows a toggle lever tensioning device, partly in axially longitudinal section, partly in side view, with a working cylinder in accordance with the invention during the power stroke (tensioning), end position.
Figure 9:
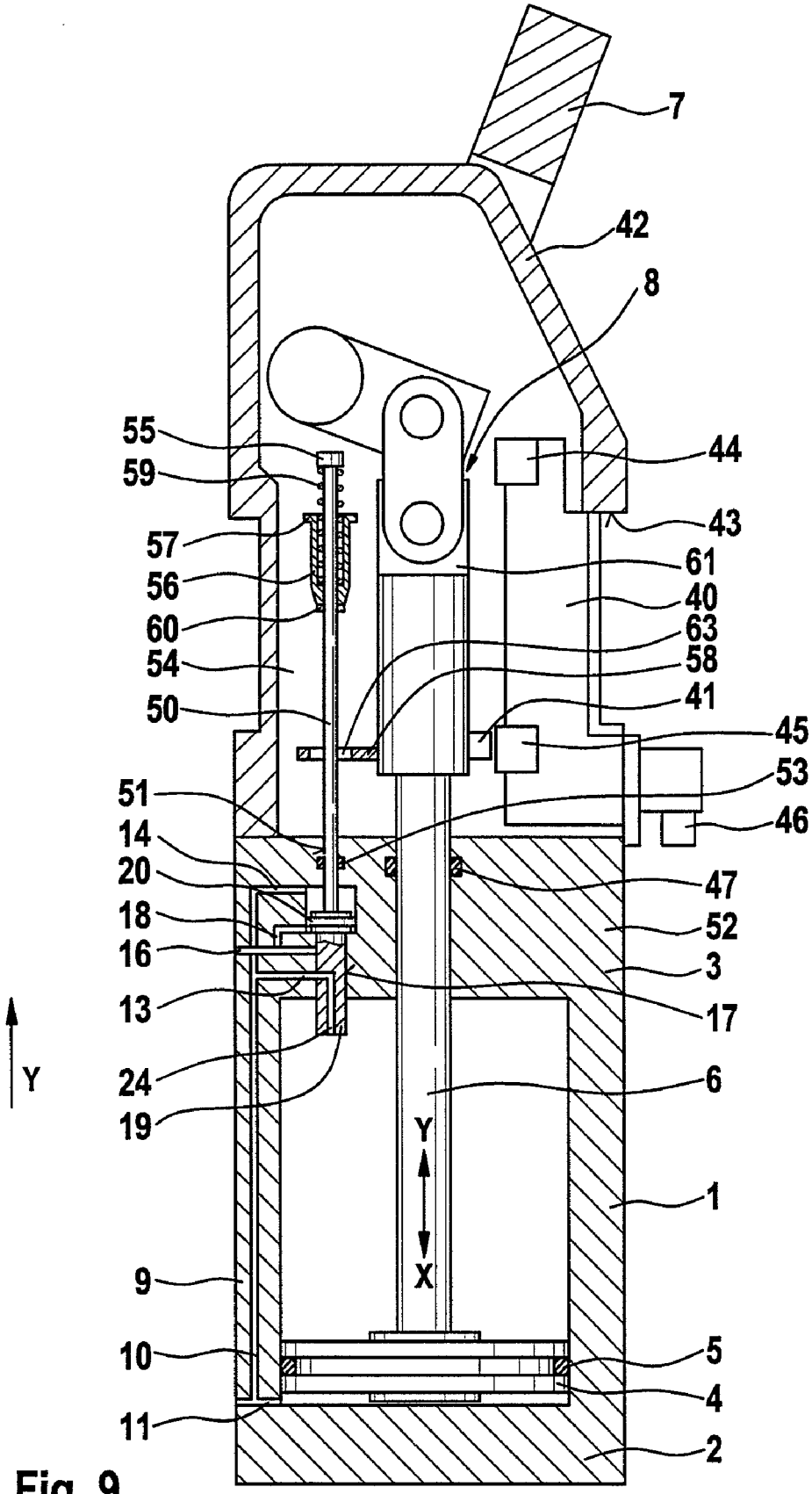
FIG. 9 shows the toggle tensioning device shown in FIG. 8 in the open position (piston) in the opposite end position after completion of the opening stroke and FIG. 10 shows the toggle lever tensioning device shown in FIGS. 8 and 9 during the setting stroke (idle stroke) (intermediate position of the piston).
Figure 10:
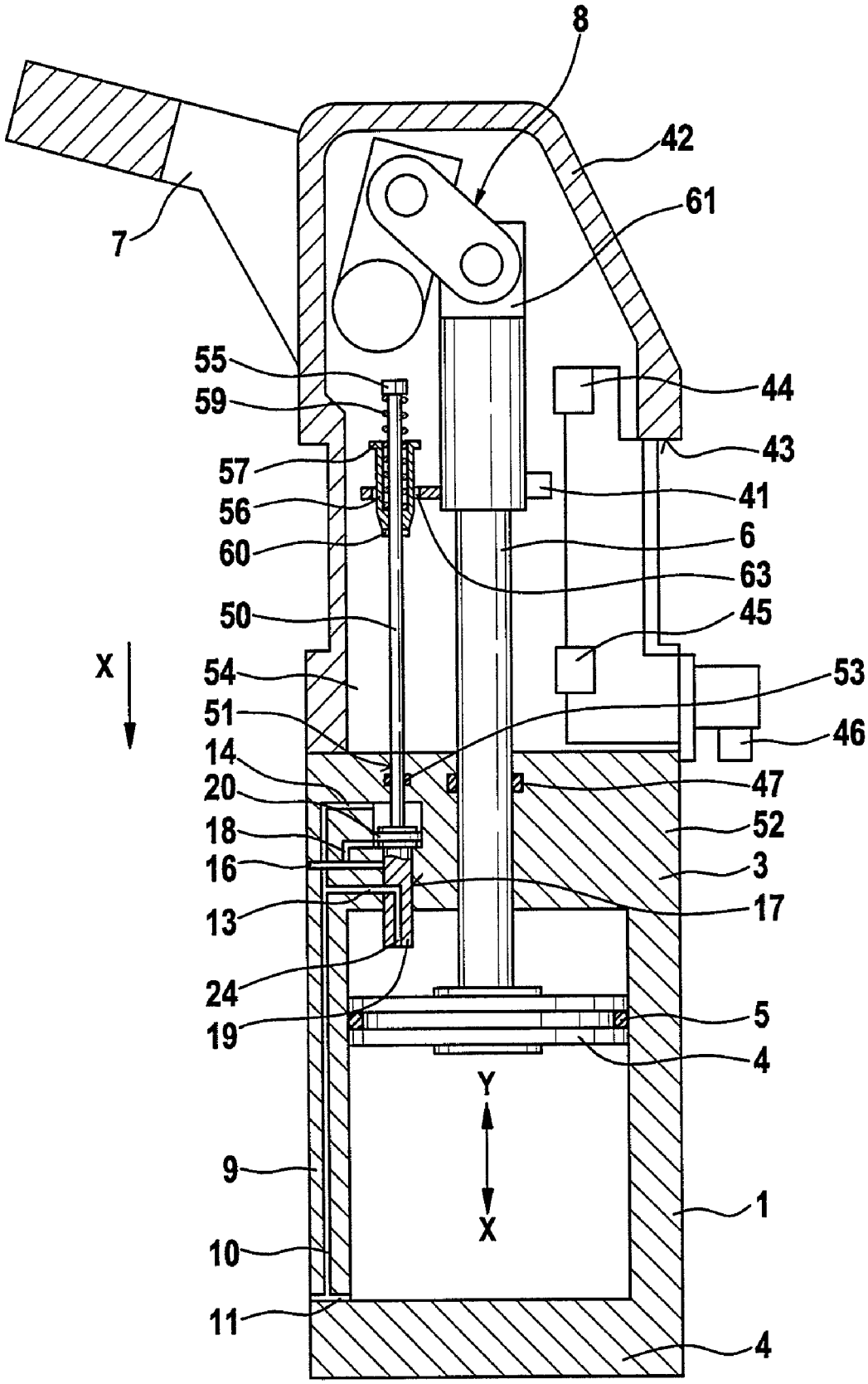

FIGS. 8 to 10 show a further embodiment of the invention. The same reference numbers were used for parts having the same function as in the afore-described drawings. Reference number 50 refers to a coupling rod running parallel to the longitudinal axis of the piston rod 6 and guided longitudinally displaceably in a hole 51 in the wall 52 and sealed tightly against compressed medium with a seal 53.

The coupling rod 50 is connected at one end with the piston valve 19 materially or functionally as a single element, for example, by a screw thread. Otherwise the coupling rod 50 projects into a space 54 in the tensioning head and is disposed at a distance from the outer periphery of the piston rod 6. At its end portion facing away from the piston valve 19 the coupling rod 50 has a diameter enlargement 55. Also disposed in this area is a cup-shaped spring sleeve 56 having a single-piece flange 57 projecting outwards at its end portion facing away from the diameter enlargement 55. The spring sleeve 56 slides on the outer periphery of the round-section coupling rod 50 by a hole 58.

Provided for in the spring sleeve 56 is a pretensioned compression spring element 59 which in the present case is constructed as a helical compression spring. The compression spring element 59 is resiliently braced at one end against the diameter enlargement 55 and at the other end by its front end in the deepest part of the spring sleeve 56. The compression spring element 59 is guided and retained axially and radially by the spring sleeve over a large part of its axial length. The compression spring element 59 has the tendency to expand and move the spring sleeve 56 by its front end up against a stop 60 which is connected as a single piece to the coupling rod 50. The stop 60 can be in the form of a transverse pin, a bolt, an expanding mandrel or the like which is rigidly disposed in a hole running at right angles to the longitudinal axis of the coupling rod 50 and limits the displacement of the spring sleeve in direction X.

Connected firmly to the piston rod 6, in the present case to the fork head of the toggle lever arrangement 8 assigned to the piston rod 6, is a coupling 62 which accordingly moves in direction Y or X during the lifting movement of the piston rod 6. The coupling 62 is in the present case constructed as a sheet metal element set at right angles to the longitudinal axis of the piston rod 6 and having a through-hole which is larger than the outside diameter of the spring sleeve 56 so that the spring sleeve can slide through this hole in the coupling 56. However, the hole in the coupling 66 is smaller than the outside diameter of the flange 57 of the coupling sleeve so that the coupling 62 can engage the flange 57 from below and, when moving in direction Y and at the same time compressing the compression spring element 59, carry it with it (FIG. 8). FIG. 10 shows how the coupling 62 slides over the spring sleeve 56, while FIG. 9 shows an arrangement where the spring sleeve under corresponding relaxation of the compression spring element 59 has been displaced in direction X against the stop 60. The hole 63 in the coupling 62 is also suitably dimensioned to enable it to slide over the stop 60.

The arrangement is such that immediately on completing the idle stroke (setting stroke) in direction Y the coupling 62 comes up against the underside of the flange 57 of the spring sleeve 56 and under compression of the compression spring element 59 moves the coupling rod 50 over the diameter enlargement 55 in direction Y, causing the piston valve 19 also to be displaced in direction Y. This results in a control reverse as described in the preceding such that now the full pressure from the compressed medium acts on the underside (piston-side) and so the full tensioning force is available on the tensioning arm of the toggle lever tensioning device.

Naturally this design and this principle can also be used for other devices, for example, for clinching and punching devices, welding devices with toggle lever arrangements and devices for joining, embossing and tensioning. The compression spring element 59 here prevents sudden contact and ensures a precise but suitably cushioned reversal of the piston valve 19.

The features shown in the abstract, the patent claims and the description and on the drawing can be important for realization of the invention either individually or in any desired combination.

LIST OF REFERENCES

1 Cylinder
2 Cylinder base
3 Cylinder cover
4 Piston
5 Sealing element
6 Piston rod
7 Device parts
8 Toggle lever arrangement
9 Cylinder wall
10 Longitudinal duct
11 Transverse duct
12 Working cylinder chamber
13 Branch duct
14 Duct portion
15 Chamber
16 Duct
17 Hole
18 Chamber duct
19 Piston valve
20 Piston
21 Cylinder return chamber, piston-ring side
22 Cylinder chamber
23 Cylinder chamber
24 Longitudinal duct
25 Branch duct
26 Valve chamber
27 Piston valve
28 Longitudinal portion, middle
29 Annular chamber
30 Duct
31 Duct portion
32 Push rod
33 Piston
34 Chamber
35 Compression spring element
36 Partition wall
37 Branch duct
38 Duct portion
39 Multi-port valve
40 Device
41 Switching flag
42 Tensioning head
43 Slot
44 Device part
45 Device part
46 Plug, electrical, electronic
47 Seal
48 Compression spring element
49 Control pin
50 Coupling rod
51 Hole
52 Wall
53 Seal
54 Space
55 Diameter enlargement
56 Spring sleeve
57 Flange
58 Hole
59 Compression spring element
60 Stop
61 Fork head
62 Coupling
63 Opening
X Direction of stroke
Y Direction of stroke

BIBLIOGRAPHY

Prospectus of Tünkers Maschinenbau GmbH, Ratingen, "Tensioning Technology for Professional Series Production"
Prospectus of Tünkers Maschinenbau GmbH, Ratingen, "Product Range"
Prospectus of Tünkers Maschinenbau GmbH, Ratingen, "Tensioning Systems, Handling, Forming Technology"
DE 196 16 441 C1
DE 198 24 579 C1
DE 199 30 990 C1

The invention claimed is:

1. A piston-cylinder unit (working cylinder), primarily for use in the manufacture of motor vehicle bodywork, with at least one piston which is longitudinally and sealingly displaceable in a cylinder by fluid pressure and which is on one side assigned a piston rod which is made to project from the cylinder and which powers device parts for tensioning and/or joining and/or stamping and/or embossing and/or punching and/or welding, if necessary, under interposition of gear parts, where during the idle stroke (setting stroke) of the piston the fluid feed is controlled in such a way that only the inertia and/or gravitational forces and/or frictional forces of moveable parts are overcome and the piston is not loaded with pressure from the fluid until the power stroke, characterized in that a transverse duct is connected to the working cylinder chamber, which transverse duct is connected at one end to a fluid source or is to be evacuated of air and can be connected to the cylinder return chamber via a longitudinal duct disposed in a wall of the cylinder and via a branch duct via a longitudinal duct into a piston valve, where the longitudinal duct can be connected via a branch duct alternately to the longitudinal duct or a duct which can be connected either to the fluid source or is to be evacuated of air via the cylinder return chamber.

2. The piston-cylinder unit (working cylinder) in accordance with claim 1, characterized in that the piston is path-dependently loaded on the piston side with pressure from the fluid during the power stroke.

3. The piston-cylinder unit (working cylinder) in accordance with claim 1, characterized in that the piston side is pressure-dependently loaded with pressure from the fluid during the power stroke.

4. The piston-cylinder unit (working cylinder) in accordance with claim 1, characterized in that the piston is loaded both on the piston side and on the piston-ring side with the same pressure from the compressed fluid during the idle stroke (setting stroke).

5. The piston-cylinder unit (working cylinder) in accordance with claim 1, characterized in that the fluid to the piston-ring side is controlled via a valve or a piston valve and that the fluid is also controlled via the same valve or the piston valve to the piston side and the piston-ring side during the idle stroke.

6. The piston-cylinder unit (working cylinder) in accordance with claim 1, characterized in that the piston valve is longitudinally displaceably and sealingly guided in a hole via a piston, where the piston is disposed in a chamber which can either be connected to the fluid source via a chamber duct or is to be evacuated of air, while the cylinder chamber of the chamber disposed on the opposite side is connected to the longitudinal duct via a duct portion.

7. The piston-cylinder unit (working cylinder) in accordance with claim 1, characterized in that the hole, the piston valve and the cylinder chambers separated from each other by the piston of the piston valve are disposed in the cylinder cover and that the longitudinal axis of the piston valve extends parallel to the longitudinal axis of the piston rod and the piston valve is disposed so that it can be pushed into the cylinder return chamber over a limited portion of its length and displaced by the piston when the power stroke is initiated.

8. The piston-cylinder unit (working cylinder) in accordance with claim 1, characterized in that the fluid can be fed to the cylinder chamber subdivided by the piston into a working cylinder chamber and a cylinder return chamber under the control of a multi port valve which is incorporated into a system control system and which at the beginning of the idle stroke loads the working cylinder chamber and the cylinder return chamber simultaneously with pressure from the fluid until the power stroke is initiated and, when the power stroke is initiated, the feed of the fluid to the cylinder return chamber is interrupted and the cylinder return chamber is evacuated of air.

9. A piston-cylinder unit (working cylinder) comprising a piston which is guided in a longitudinally displaceable and sealing manner in a cylinder by fluid pressure and to which a piston rod led out of the cylinder in a sealing manner is connected on one side, the piston rod driving device parts for clamping and/or pressing and/or joining and/or punching and/or embossing and/or perforating and/or welding, wherein passages are connected to the working cylinder, the passages enabling the fluid pressure to be applied to a working cylinder space and to a cylinder return stroke space from the start to the end of the idling stroke (setting stroke) and vent the cylinder return stroke space and only apply fluid pressure to the working cylinder space at the start of the initiation of the power stroke, wherein a control pin is provided in a bore to the piston on a side of the piston rod, which control pin is mounted against the return force of a preloaded compression spring element and, during the initiation of the power stroke, actuates a valve in such a way that the piston ring side can be vented or that the cylinder return stroke space is connected to the fluid feed and/or discharge line via a control system.

10. The piston-cylinder unit (working cylinder), mainly for use in body construction in the motor vehicle industry, comprising at least one piston which is guided in a longitudinally displaceable and sealing manner in a cylinder by fluid pressure and to which a piston rod led out of the cylinder is connected on the one side, the piston rod driving device parts for clamping and/or joining and/or punching and/or embossing and/or welding and/or perforating, wherein the fluid feed can be controlled during the idling stroke (setting stroke) of the piston in such a way that only the inertial forces and/or forces due to weight and/or frictional forces of movable parts are overcome and the fluid pressure cannot be applied to the piston until during the power stroke, wherein a control pin is provided in a bore to the piston on a side of the piston rod, which control pin is mounted against the return force of a preloaded compression spring element and, during the initiation of the power stroke, actuates a valve in such a way that the piston ring side can be vented.

11. A piston-cylinder unit (working cylinder), mainly for use in body construction in the motor vehicle industry, comprising at least one piston which is guided in a longitudinally displaceable and sealing manner in a cylinder by fluid pressure and to which a piston rod led out of the cylinder is connected on the one side, the piston rod driving device parts for clamping and/or joining and/or punching and/or embossing and/or welding and/or perforating, wherein the fluid feed can be controlled during the idling stroke (setting stroke) of the piston in such a way that only the inertial forces and/or forces due to weight and or frictional forces of movable parts are overcome and the fluid pressure cannot be applied to the piston until during the power stroke, wherein a fork head connected to the piston rod or a toggle lever joint arrangement connected thereto controls a valve upon completion of the idling stroke (setting) in such a way that the full fluid pressure now acts on the piston.

12. A piston-cylinder unit (working cylinder) comprising:

a cylinder;

a piston assembly provided in the cylinder, the piston assembly comprising a piston having first and second opposing major surfaces and a piston rod attached to the second major surface, at least a portion of the piston rod extending out of the cylinder in a sealing manner to drive device parts for clamping and/or pressing and/or joining and/or punching and/or embossing and/or perforating and/or welding, the piston being guided in a longitudinally displaceable and sealing manner in the cylinder by fluid pressure applied to a working cylinder chamber adjacent the first major surface of the piston and a cylinder return chamber adjacent the second major surface of the piston;

a plurality of passages connected to the working cylinder chamber and to the cylinder return chamber to enable a pressurized fluid to be introduced into or evacuated from the working cylinder chamber and the cylinder return chamber;

a valve movable between a plurality of positions to connect or disconnect the plurality of passages, the valve being actuated by the second surface of the piston or by a member operably connected to the piston or to the piston rod for actuating the valve based on a position of the piston and piston rod, wherein the passages, valve and member are configured such that the passages enable the fluid pressure to be applied to a working cylinder chamber and to the cylinder return chamber from a start to an end of an idling stroke (setting stroke), vent the cylinder return chamber and only apply fluid pressure to the working cylinder chamber at a start of initiation of a power stroke, and allow the cylinder return chamber to be connected to fluid pressure during an opening stroke.

13. The piston-cylinder unit (working cylinder) according to claim 12, wherein the member is a control pin provided in a bore in the piston, the control pin extending from a second surface of the piston into the cylinder return chamber and being mounted against the return force of a preloaded compression spring element.

14. The piston-cylinder unit (working cylinder) according to claim 12, wherein the member is a fork head operably connected to the piston rod.

* * * * *